United States Patent [19]

Flaherty et al.

[11] Patent Number: 4,685,993

[45] Date of Patent: Aug. 11, 1987

[54] APPARATUS FOR BINDING PACKAGES TOGETHER

[75] Inventors: Kenneth A. Flaherty; Daniel J. Huber; Robert T. Lewis, all of Louisville, Ky.

[73] Assignee: Brown & Williamson Tobacco Corporation, Louisville, Ky.

[21] Appl. No.: 830,401

[22] Filed: Feb. 18, 1986

[51] Int. Cl.[4] ..... B65C 1/04

[52] U.S. Cl. ..... 156/475; 53/399; 53/415; 53/589; 156/567

[58] Field of Search ..... 53/399, 415, 589; 156/443, 475, 483, 484, 567, 478

[56] References Cited

U.S. PATENT DOCUMENTS 2,968,137 1/1961 De Mallie ..... 53/415 X 4,198,258 4/1980 Glösmann ..... 156/484

*Primary Examiner*—Robert A. Dawson

*Attorney, Agent, or Firm*—Charles G. Lamb

[57] ABSTRACT

An apparatus for banding at least two stacked packages together in superimposed registered relationship by applying a band to two consecutive sides of the package stack concentric with the interface of the packages of the stack. The apparatus includes a turret having stacked package receiving pockets in its periphery, a band applicator located at the periphery of the turret to apply the band to the exposed sides of the stack of packages in each pocket as the turret rotates each pocket past the band applicator with a portion of the band trailing behind the trailing edge of the package stack, and a band folding channel located downstream, relative to the direction of rotation of the turret, from the band applicator for receiving stacked packages from the turret pockets and folding the trailing portion of the band over the adjacent side of the package stack.

5 Claims, 3 Drawing Figures

APPARATUS FOR BINDING PACKAGES TOGETHER

BACKGROUND OF THE INVENTION

1. Field of the Invention

The present invention relates to an apparatus for applying labels to packages, and more particularly to applying a band to a stack of at least two packages to band the packages together.

2. Description of the Prior Art

An apparatus for applying a label to two or more adjacent sides of a package are known. The following U.S. Patents are exemplary of the prior art. U.S. Pat. No. 3,869,330 issued on Mar. 4, 1975 to A. W. Anderson, et. al; U.S. Pat. No. 4,032,386 issued on June 28, 1977 to R. Fleet; U.S. Pat. No. 4,086,744 issued on May 2, 1978 to E. Seragnoli; U.S. Pat. No. 4,124,429 issued on Nov. 7, 1978 to M. Crankshaw; U.S. Pat. No. 4,181,561 issued on Jan. 1, 1980 to E. Seragnoli; U.S. Pat. No. 4,198,258 issued on Apr. 15, 1980 to J. Glosmann; U.S. Pat. No. 4,227,955 issued on Oct. 14, 1980 to Q. T. Woods, et. al; U.S. Pat. No. 4,312,699 issued on Jan. 26, 1982 to O. Erdman; and U.S. Pat. No. 4,462,851 issued on Jan. 31, 1984 to G. Colgate.

The apparatus of these prior art patents are complicated in structure and, therefore, expensive to make and maintain in operation. In addition, the apparatus of these patents must be quite large relative to the size of the package to which the label is attached, therefore, taking up expensive floor space in a manufacturing facility. In addition, none of these prior art patents disclose an apparatus for banding at least two stacked packages together in superimposed registered relationship.

SUMMARY OF THE INVENTION

The present invention provides an apparatus for banding at least two packages together in stack by applying a band to several consecutive surfaces of the package stack.

The present invention further provides an apparatus of the class described by further locating the band symmetrical with the interface of the packages of the stack. More particularly, the present invention provides an apparatus for banding two stacked packages together in superimposed registered relationship comprising a rotatable turret having a plurality of stacked package receiving pockets spaced apart about the circumference of the turret, each pocket being open to the periphery of the turret, each pocket being sized to receive at least two packages in superimposed registered relationship, and each pocket having a package stack ejector opening formed through the pocket wall opposite the pocket opening at the periphery of the turret; a stacked package feed channel located at the periphery of the turret for guiding a stack of at least two superimposed registered packages into the package receiving pockets as the rotating turret positions a pocket at the package feed channel; a band applicator device located at the periphery of the turret downstream of the package feed channel relative to the direction of rotation of the turret for applying a band to the surfaces of the stacked packages located in the pockets exposed at the pocket opening at the periphery of the turret symmetrically of the interface of the stacked registered packages with a portion of the band trailing behind the trailing edge of the package stack as the rotating turret moves each pocket past the band applicator device; a band folding channel located at the periphery of the turret downstream of the band applicator device relative to the direction of rotation of the turret for receiving stacked packages from a pocket as the rotating turret locates a pocket at the band folding channel, the band folding channel being of a dimension to receive a stack of packages with a slide fit so as to cause the trailing portion of the band to fold over the side of the package stack adjacent the package surfaces to which the applicator device applied the band as the package stack moves into the band folding channel; and, stacked package ejector means movable through the package ejector opening of the pocket toward the opening of the pocket at the periphery of the turret for engaging a package stack in the pocket located at the band folding channel and moving the package stack from the pocket into the band folding channel.

BRIEF DESCRIPTION OF THE DRAWINGS

The objectives and advantages of the present invention will become even more clear upon reference to the following description in conjunction with the accompanying drawings in which like numerals refer to like parts throughout and wherein.

DETAILED DESCRIPTION OF THE PREFERRED EMBODIMENT

Figure 1:
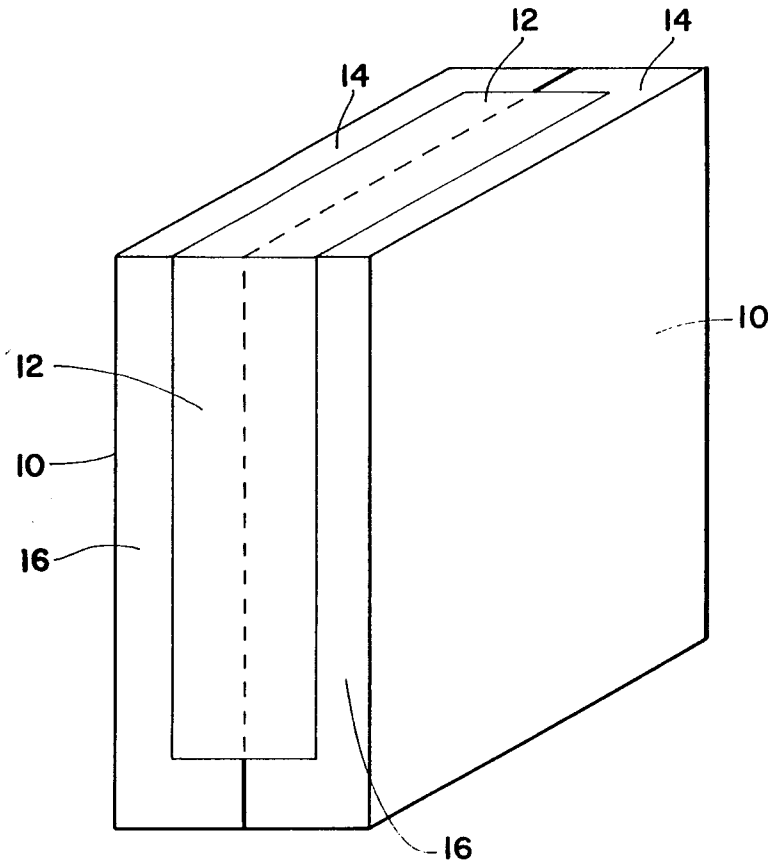
FIG. 1 is a perspective view of a package stack of two superimposed registered packages banded together by the apparatus of the present invention.

FIG. 1 illustrates two packages 10 stacked one upon the other in superimposed registered relationship, and fastened together by a band 12 centered on the interface between the two packages 10 and affixed to the adjacent two sides 14 and 16 of the packages.

Figure 2:
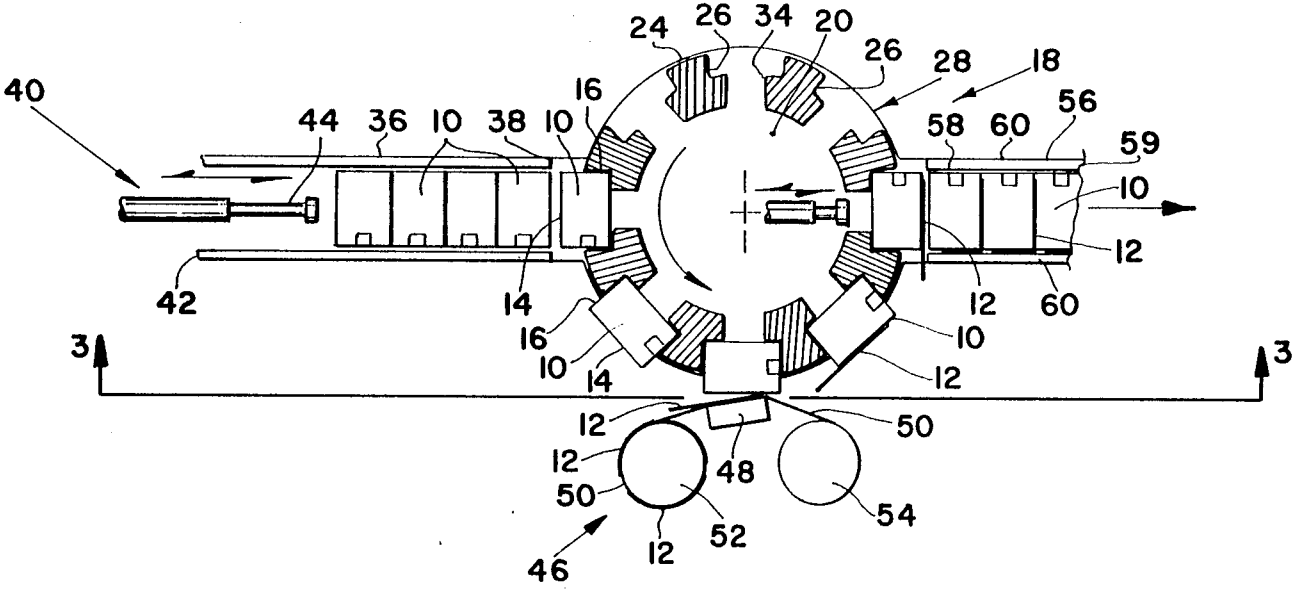
FIG. 2 is a schematic top view of the apparatus of the present invention.
Figure 3:
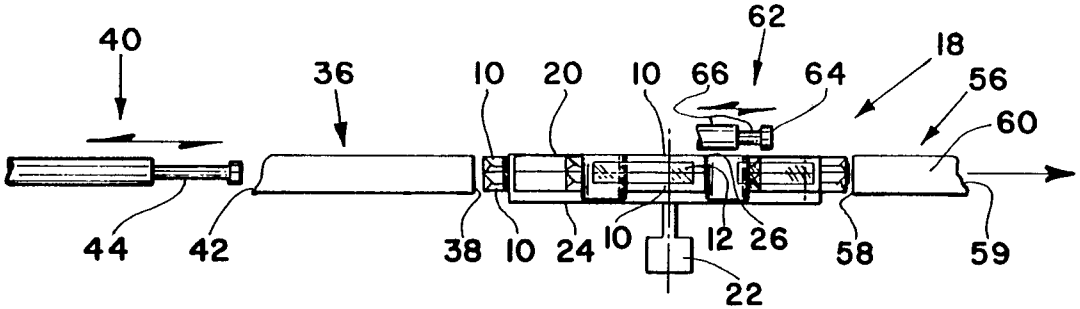
FIG. 3 is a schematic side view of the apparatus of FIG. 2.

FIGS. 2 and 3 illustrate an apparatus, generally denoted as the numeral 18, of the present invention for applying the band 12 to several consecutive or adjacent sides of the stack of packages 10.

The apparatus 18 comprises a turret 20 adapted to rotate in the direction indicated by the arrow "A" about its geometric center. The turren 20 can be rotated by virtually any means known to the art such as, for example, an electric motor 22. As illustrated the turret 20 includes a peripheral wall 24.

A plurality of package stack receiving pockets 26 that are formed in the peripheral wall 24 have openings 28 at the peripheral surface of the peripheral wall 24 such that one surface, for example surfaces 14 of the packages 10 of a package stack in a pocket 26 are exposed at the periphery of the turret 20. Each pocket 26 is sized to receive a stack of at least two superimposed registered packages 10, and preferably the pockets 26 have a depth less than the depth of the packages 10 so that the packages will project outwardly through the pocket opening 28 beyond the peripheral surface of the peripheral wall 24.

In addition, each pocket 26 is formed with a package stack ejector opening 30 formed through the pocket wall opposite the pocket opening 28 at the peripheral surface of the turret wall 24. Furthermore, as shown, an ejector clearance slot 34 is formed through each side wall of each pocket 26 generally radially of the turret 20 open at one end to the pocket opening 28 and open at the other end to the ejector opening 30.

A stacked package feed magazine 36 is located at the periphery of the turret 20 for guiding a stack of packages 10 into the package stack receiving pockets 26 as the rotating turret 20 positions each pocket 26 at the feed magazine 36. The magazine 36 has an outlet opening 38 at the periphery of the turret 20. A package stack moving device 40 is located at the opposite end 42 of the magazine 36 to push package stacks out of the magazine outlet opening 38 into the pocket 26 aligned with the magazine outlet opening 38. Toward this objective, the package moving device 40 is illustrated as a reciprocating device such as a pneumatic cylinder having a reciprocating operating rod 44 which contacts package stacks in the magazines 36 to push them out of the magazine through outlet opening 38 and into the pocket 26 through pocket opening 28. The package moving device 40 is operated in a manner known to the art to move in timed relationship to the rotation of the turret 20.

A band applicator device 46 is located at the periphery of the turret 20 for applying the band 12 to the surfaces 14 of the package stack located in the turren pockets 26 exposed at the pocket opening 28 at the periphery of the turret 20. The band applicator device 46 applies a band 12 symmetrically of the interface of the stacked registered packages 10 with a portion of the band 12 trailing behind the trailing edge of the package stack as the rotating turret moves each pocket 26 past the band applicator device 46. It should be noted that the trailing edge of the package stack is the corner of the package stack formed by the intersection of the package surfaces 14 and the consecutive adjacent package surfaces 16 to which the band will eventually also be attached forming a so-called "wrap around band". The band applicator device 46 can be of virtually any type. However, for the sake of illustration it is illustrated as comprising a band applicator pad 48 located at the periphery of the turret 20. A supply web 50 carrying individual bands 12 thereon in a known manner is passed over the surface of the applicator pad 48 facing the periphery of the turret 20 from a supply reel 52 to a web take-up reel 54. The individual bands 12 are attached to the web 50 by a low affinity adhesive and the surface of each band 12 facing outwardly of the web 50 has a pressure sensitive adhesive. The feed of the web 50 of bands 12 past the pad 48 is controlled to move a band 12 over the exposed ends 14 of a package stack in each pocket 26 in timed relationship to the rotation of the turret 20. This can be accomplished by rotatably driving the take up reel 54 in timed relationship with the rotation of the turret 20 in various well-known ways. In operation, as the turret 20 positions a pocket 26 having a package stack beneath the applicator pad 48, the applicator pad forces the suface of a band 12 having the pressure sensitive adhesive against the exposed surfaces 14 of the packages 10 of the package stack. As the turret 20 continues to rotate, it carries the package stack away from the pad 48 causing the band 12 adhering to the package stack to easily strip the band 12 from the web due to the low affinity adhesion of the band 12 to the web 50. The band 12 is positioned on the exposed ends 14 of the package stack so as to extend beyond the trailing edge of the package stack as defined above.

A band folding channel, generally denoted as the numeral 56, is located at the periphery of the turret 20 downstream of the band applicator device 46 relative to the direction of rotation of the turret 20. The band folding channel 56 has an inlet opening 58 at the periphery of the turret 20 for receiving package stacks from a pocket 26 as the turret 20 locates a pocket 26 at the turret 20 locates a pocket 26 at the band folding channel 56. The band folding channel 56 is configured and dimensioned to generally correspond to conform with the package stack so that the band folding channel 56 will receive the package stack with a close slide fit. Thus, as the package stack is received in the band folding channel 56, the channel walls 60 co-act with trailing extending portion of the band 12 to cause the trailing band portion to fold over the sides 16 of the packages 10 of the package stack adjacent the package surfaces 14 to which the band 12 was initially applied by the band applicator device 46, thus, forming a "wrap around" band 12 adhering to two adjacent consecutive surfaces of the packages of the package stack symmetrical with the interface between the packages 10. The band folding channel 56 also has an outlet opening 59 at the end of the channel 56 opposite the inlet opening 58 of the channel 56.

The apparatus 18 further includes stacked package ejector means, generally denoted as the numeral 62, for removing package stacks from the pockets 26 of the turret 20 into the band folding channel 56. The stacked package ejector means 62 is illustrated as including a stacked package engaging flange 64 reciprocally movable in the ejector clearance slot 34 of the pockets 26 between the ejector opening 30 of the pockets 26 and the pocket opening 28 at the periphery of the peripheral wall 24 of the turret 20. The engaging flange 64 contacts the package stack in a pocket 26 at the ejector opening 30 and pushes the package stack out of the pocket 26 through the pocket opening 28 into the band folding channel 56 through the channel inlet opening 58. Then, the package engaging flange 64 is reciprocally returned to a position outside the pocket 26 adjacent the ejector opening 30 of the pocket 26 so that the turret 20 can continue to be rotated to position the next pocket 26 at the band folding channel 56. Toward this objective, the ejector means 62 can include, for example, a pneumatic cylinder device 66 having its operating rod 68 connected to the package engaging flange 64. The ejector means is activated in known ways in timed relationship to the rotation of the turret 20 to move into engagement with a package stack only when a turret pocket 20 is in alignment with the inlet opening 58 of the band folding channel 56. As package stacks are moved into the band folding channel 56, they contact package stacks previously moved into the folding channel 56 pushing these package stacks out of the band folding channel 56 through the outlet opening 59.

The foregoing detailed description is given primarily for clearness of understanding and no unnecessary limitations should be understood therefrom for modifications will become obvious to those skilled in the art upon reading this disclosure and may be made without departing from the spirit of the invention and scope of the appended claims.

What is claimed is:

1. An apparatus for banding at least two stacked packages together in superimposed registered relationship comprising:

a rotatable turret having a plurality of stacked package receiving pockets spaced apart about the circumference of the turret, each pocket being open to the periphery of the turret;

means for rotating the turret;

stacked package feed means located at the periphery of the turret for guiding a stack of packages into the package receiving pockets;

band applicator means located at the periphery of the turret downstream of the package feed means relative to the direction of rotation of the turret for applying a band to the surfaces of the stack of packages in the pockets exposed at the pocket openings at the periphery of the turret symmetrically of the stacked packages with a portion of the band trailing behind the trailing edge of the package;

band folding means located at the periphery of the turret downstream of the band applicator means relative to the direction of rotation of the turret for folding the trailing edge of the band over the adjacent side of the package stack as the package stack is removed from the pockets; and, stacked package ejector means for removing the package stacks from the pockets in the turret into the band folding means.

2. The apparatus of claim 1, wherein the turret comprises:

each pocket being sized and configured to receive at least two packages in superimposed registered relationship; and, each pocket having a package stack ejector opening formed through the pocket wall opposite the pocket opening at the periphery of the turret.

3. The apparatus of claim 1, wherein the stacked package feed means comprises a magazine located at the periphery of the turret for guiding a stack of packages into the package receiving pockets as the rotating turret positions a pocket at the package feed magazine.

4. The apparatus of claim 1, wherein the band folding means comprises a band folding channel having an inlet end at the periphery of the turret, the band folding channel being configured and dimensioned to receive a stack of packages with a slide fit so that a wall of the channel contacts the trailing portion of the band and causes it to fold over the side of the stacked packages adjacent the package surfaces to which the band applicator device applied the band as the package stack moves into the band folding channel.

5. The apparatus of claim 2, wherein the stacked package ejector means comprises means for engaging the stacked packages in the pockets at the ejector opening in the pocket and pushing the stacked packages out of the pockets through the pocket opening at the periphery of the turret in a direction toward the band folding means.

* * * * *